US007997206B2

(12) United States Patent
Ivanov

(10) Patent No.: US 7,997,206 B2
(45) Date of Patent: Aug. 16, 2011

(54) BULLET SHELL FOR SMOOTHBORE AND RIFLED CHOKE HUNTING GUNS

(76) Inventor: Michael Y. Ivanov, Moscow (RU)

( * ) Notice: Subject to any disclaimer, the term of this patent is extended or adjusted under 35 U.S.C. 154(b) by 280 days.

(21) Appl. No.: 12/274,840

(22) Filed: Nov. 20, 2008

(65) Prior Publication Data

US 2009/0151592 A1 Jun. 18, 2009

(30) Foreign Application Priority Data

Dec. 13, 2007 (RU) ..... 2007146186

(51) Int. Cl.
*F42B 12/78* (2006.01)
*F42B 14/00* (2006.01)
*F42B 30/02* (2006.01)

(52) U.S. Cl. ..... 102/520; 102/509; 102/514

(58) Field of Classification Search ..... 102/514, 102/515, 520, 521, 522, 523, 501, 507, 508, 102/509, 516, 517, 518
See application file for complete search history.

(56) References Cited

U.S. PATENT DOCUMENTS

| | | | | | |
|---|---|---|---|---|---|
| 5,012,744 | A | * | 5/1991 | Sowash | 102/523 |
| 5,016,538 | A | * | 5/1991 | Sowash | 102/520 |
| 5,103,736 | A | * | 4/1992 | Sowash | 102/523 |
| 5,175,359 | A | * | 12/1992 | Fried | 562/537 |
| 5,175,394 | A | * | 12/1992 | Sowash | 102/522 |
| 5,214,238 | A | * | 5/1993 | Young | 102/520 |
| 5,263,418 | A | * | 11/1993 | Dippold et al. | 102/509 |
| 5,408,931 | A | * | 4/1995 | Tallman | 102/439 |
| 5,479,861 | A | * | 1/1996 | Kinchin | 102/439 |
| 5,515,787 | A | * | 5/1996 | Middleton | 102/503 |
| 6,073,560 | A | * | 6/2000 | Stone | 102/522 |
| 6,105,506 | A | * | 8/2000 | Gangale | 102/439 |
| 6,814,006 | B2 | * | 11/2004 | Johansson | 102/522 |

FOREIGN PATENT DOCUMENTS

RU 2308672 10/2007

OTHER PUBLICATIONS

V.P. Kostenko, "Bullets for Smooth-Bore Hunting Guns", Moscow, The Ruchenkins Publishers, 2003, pp. 139-140, Fig. 71.
English translation of V.P. Kostenko, "Bullets for Smooth-Bore Hunting Guns", Moscow, The Ruchenkins Publishers, 2003, pp. 139-140, Fig. 71.
English abstract of RU2308672 (C1)—1 page, Oct. 20, 2007.

* cited by examiner

*Primary Examiner* — James S Bergin
(74) *Attorney, Agent, or Firm* — Rader, Fishman & Grauer PLLC

(57) ABSTRACT

Disclosed is a bullet shell for hunting guns, preferably those having barrels with "rifled choke" rifling. The shell comprises a bullet made of a solid material and a thin-wall plastic envelope. On its surface, the bullet has a trapezoidal groove delimiting nose and heel portions of the bullet. The envelope enclosing the bullet is made of identical longitudinal halves having a cylindrical outer surface and an inner surface matching with the surface of the bullet. A peripheral flat collar of a width of b and a height of $b_1$=0.5b is provided at the bullet nose portion end surface. The collar passes into a taper boring with an apex angle $\alpha$=120±5°, and the envelope protrudes by $b_2$=$b_1$ beyond the plane of the bullet collar. The bullet shell offers improved longitudinal stability when shooting through minor obstacles (bushes, grass) and improved grouping of up to 60 mm at 100 m.

6 Claims, 1 Drawing Sheet

BULLET SHELL FOR SMOOTHBORE AND RIFLED CHOKE HUNTING GUNS

CROSS-REFERENCE TO RELATED APPLICATIONS

This application claims priority to Russian application 2007146186/02(050617) filed on Dec. 13, 2007, which is hereby incorporated by reference in its entirety.

BACKGROUND OF THE INVENTION

1. Field of the Invention

The invention relates to bullet shells with a solid bullet and is suitable for firing hunting guns, preferably the guns having rifled choke barrels, within a range of up to 100 m.

2. Description of the Related Art

Rifled choke barrels were invented over 100 years ago and never gained wide acceptance due to the lack of good bullet shells suitable for the same. The patent for the rifled choke was granted to British colonel G. V. Fosberry as early as 1884. The essence of the invention consists in that the choke narrowing of a conventional smoothbore shotgun barrel is provided with rifles enabling a lead bullet to be twisted about an axis after it has passed through the rifled choke. Until 1910, the patent for the rifled choke was owned by Holland & Holland. At the time when Fosberry obtained his patent the smoothbore gun bullets had a speed not exceeding 350 m/s. However, the rifled choke is ineffective when shooting with the lead bullets whose speed exceeds 400 m/s. Long-lasting and unsuccessful experiments with various lead bullet designs for the rifled choke resulted in that a lot of gun makers tended towards the opinion that rifled chokes is a deadlock. However, the problem lies in the lack of bullet shells for such guns able to work, i.e. rotate about an axis at speeds exceeding 400 m/s and leaving the bore with no lead coating. The bullets used for rifled choke guns are usually made of a lead alloy with the following content: 85% of lead, 10% of tin and 5% of antimony. As the lead bullet passes through the rifled choke, a significant leading of the rifles occurs even after several shots whereby the grouping of shots notably deteriorates. To ensure a good grouping, it is necessary to remove the lead coating after a few shots are fired, which is a rather time and labor consuming process. It should also be noted that when a lead bullet whose speed exceeds 400 m/s enters the rifled choke its rotating bands get cut off so that no rotary motion is imparted to the bullet, i.e. the rifled choke is ineffective at speeds exceeding 400 m/s. Due to these critical factors, such a brilliant invention as the rifled choke has now been out of wide use for over 120 years in hunting wild animals within a range of up to 100 m.

Principal bullet shell designs for the hunting guns having bores with the rifled choke are known, which comprise a single-component bullet made of a lead alloy (V. P. Kostenko, "Bullets for Smooth-Bore Hunting Guns", Moscow, The Ruchenkins Publishers, 2003, pages 139-140, FIG. 71).

As shown by the live hunting tests of many years and by indoor shooting from the smoothbore hunting guns and rifled choke guns, the main disadvantages of the prior art solutions over the claimed invention are poor internal and external ballistic characteristics thereof, i.e. increased aerodynamic resistance due to a low flight speed of the ammunition (bullet) and lack of longitudinal stability (i.e. the ammunition longitudinal axis misaligns with the direction of its flight resulting in somersaulting so that the ammunition reaches the target at an angle). All that leads to an insufficiently lasting conservation of the kinetic energy which is particularly required for killing big animals. In addition, the above solutions are characterized by an insufficient obturation as the bullet passes through the gun bore at firing because no sealing required at firing is ensured to prevent a powder gas blow-back. All that leads to insufficient stopping effect, low destructive ability and does not rule out a ricochet due to a low hitting accuracy, kill distance and penetrating performance.

The prior art closest to the claimed invention is a bullet shell for hunting guns, comprising a bullet made of a solid material with a trapezoidal groove provided on the side surface thereof, the groove delimiting a nose and a heel portions of the bullet, and a thin-wall plastic envelope enclosing the bullet, the envelope being made of two identical longitudinal halves having a cylindrical outer surface and an inner surface matching in contour with the side surface of the bullet (RU 2308672, F 42 B 30/02, Oct. 10, 2007).

This bullet shell has two significant disadvantages: 1—low longitudinal stability as the bullet passes through bushes and when shooting in a strong wind, 2—formation of huge wound hematomas in the body of an animal. However, when the bullet moves in the clear field with no obstacles such as grass, bushes, and in no wind, the grouping of shots and longitudinal stability may be referred to as excellent.

It is therefore an object of the invention to eliminate the above disadvantages. The technical effect of the invention consists in improving the external ballistics when shooting through minor obstacles (bushes, grass).

SUMMARY OF THE INVENTION

The above object and the technical effect are achieved by providing a bullet shell for hunting guns, comprising a bullet made of a solid material with a trapezoidal groove provided on the side surface thereof, said groove delimiting the bullet nose and heel portions, and a thin-wall plastic envelope enclosing the bullet, the envelope having a cylindrical outer surface and an inner surface matching in contour with the side surface of the bullet and being made of two identical longitudinal halves. Furthermore, a peripheral flat collar is provided at the end surface of the bullet nose portion, having a width b and a height $b_1$=0.5b, the collar passing into a taper boring with an apex angle $\alpha$=120±5°. The envelope is arranged to protrude beyond the plane of said bullet collar by a value $b_2$=$b_1$. Preferably, the length $l_1$ of the nose portion is 1.5 to 3 times greater than the length $l_2$ of the heel portion, and the weight of the nose portion also has to be 1.5 to 3 times greater than the weight of the heel portion.

The main gauge for the hunting guns is 12, although the invention can be used with other gauges as well. In contrast to the prior art bullet designs for rifled chokes, which are single-component and made of lead alloys, the proposed bullet shell for the rifled chokes comprises two components: a solid bullet and a plastic envelope.

The proposed two-component bullet shell with a solid bullet for the rifled choke hunting guns is advantageous for shooting within a range of up to 100 m. The invention is superior to the prior art both in terms of its stopping effect and grouping, and both when shooting in the clear field and through the bushes. By providing the bullet with a flat nose portion, the bullet energy is entirely spent on stopping an animal. The grouping of shots (bullet spread) in the proposed bullet shell when firing a rifled choke gun within a range of 100 m is 60 mm, no matter whether shots are fired through the bushes or in the clear field. By now, the grouping of all prior art bullets known to the inventor for smoothbore guns is limited to 150 mm within a range of up to 50 M. To achieve the improved grouping of shots within 60 mm within a range of up to 100 m and to provide a maximum stopping effect, rotation about an axis has to be imparted to a solid bullet by causing the same to pass through the rifling grooves of the choke. To this effect, the bullet speed has to exceed 400 m/s for stopping big and dangerous animals.

BRIEF DESCRIPTION OF THE DRAWINGS

The above and other objects, features and advantages of the present invention will become apparent from the following description of the preferred embodiment in conjunction with the accompanying drawing of FIG. 1 where the bullet shell according to the present invention is presented.

DETAILED DESCRIPTION OF THE INVENTION

Figure 1:
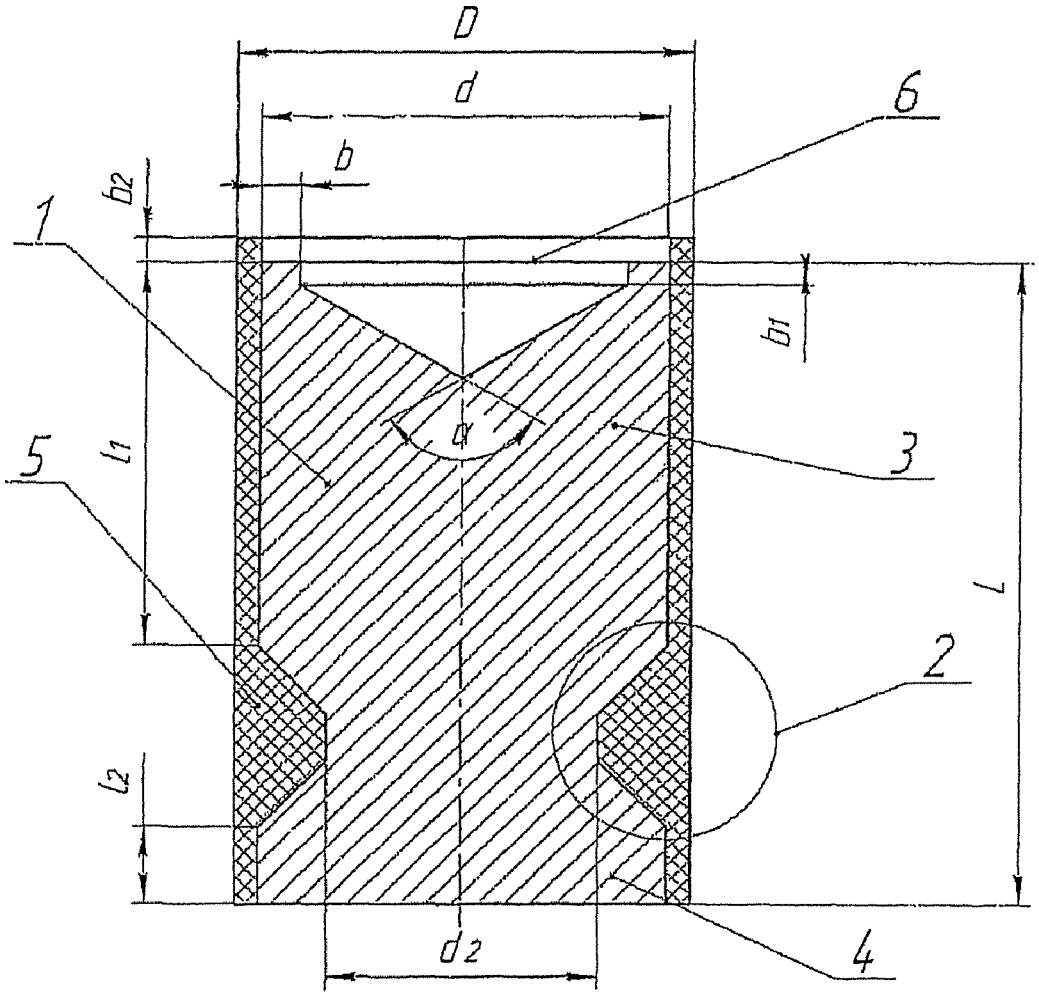

A bullet shell for hunting guns with smooth bores and rifled chokes comprises a bullet 1 made of a solid material. A trapezoidal groove 2 is provided on the side surface of the bullet, the groove delimiting a nose portion 3 and a heel portion 4 of the bullet. A thin-wall plastic envelope 5 is provided enclosing the bullet, the envelope being made of two identical longitudinal halves and having a cylindrical outer surface and an inner surface matching in contour with the side surface of the bullet. A peripheral flat collar 6 is provided at the end surface of the bullet nose portion 3. Having a width b and a height $b_1$=0.5b, the collar passes into a taper boring with an apex angle $\alpha$=120±5°. The envelope 5 is arranged to protrude beyond the plane of the bullet collar by a value $b_2$=$b_1$.

A bullet shell for rifled chokes, like the one described in the present disclosure, may be widely used for wild boar hunting, as well as for what is known as a guide gun. With the advance of commercial hunting big and dangerous animals in Russia and, especially, in the USA and Canada, a demand arose for a new type of weapon for a guide referred to as a guide gun by the American designers, and the bull shells for the same. The guide gun carried by a guide is supposed to perform a complicated and important work, namely, to stop a dangerous animal possibly wounded by the hunter.

The bullet shell according to the present disclosure provides the greatest stopping effect when shooting within a range of up to 100 M due to the structure of the solid bullet 1 that features a flat nose portion and a stepped central passage and is produced of solid materials (steel, brass, bronze, copper, cast iron, etc.) making it non-deformable within the bore and in the body of an animal.

The proposed solid bullet refers to bodies of rotation and has to be turned on a lathe. It has the pronounced, heavier nose portion 3 and the lighter heel portion 4 delimited by the trapezoidal groove 2 extending at a 45° angle. In the embodiment shown, the groove 2 is shaped as an equilateral trapezium. The plastic envelope 5 is made of soft plastic, for example, high-pressure polyethylene 18813-020, GOST 16337-77 and consists of two identical longitudinal halves. The purpose of the plastic envelope 5 is to protect the bore against damage as the solid bullet passes through the same, as well as to impart axial rotation to the bullet as it passes through the rifled choke rifles. Surprisingly, when the plastic envelope 5 passes through the rifled choke rifles, it copies their form and reverts to the original state when leaving the bore. The rifles on the outer surface of the plastic envelope disappear after it leaves the bore. In case of single-component lead bullets passing through the rifled choke rifles at a speed of up to 400 m/s, marks are left by the rifles on the side surface of bullets, i.e. the lead bullet twists about the axis. At a speed exceeding 400 m/s, no marks are left by the rifles on the lead bullet because its bands have been cut off, and the rifled choke is ineffective.

When the flat nose portion of the bullet 1 of the proposed two-component bullet shell with a solid bullet hits a big animal, it causes the nerve endings of the muscles to tear and stops the animal because of the pain shock. Upon hitting the bones, the flat collar at the end surface of the solid bullet 1 nose portion 3 breaks the same to small pieces with its sharp edges thereby intensifying the pain shock. In a real hunting field, shooting is often made through the bushes. The proposed bullet shell does not deflect from its track as it passes through the bushes due to the flat end surface of the bullet 1 nose portion 3 and its higher weight relative to the heel portion 4.

The plastic envelope 5 protrudes relative to the bullet 1 end surface by 1-1.5 mm. The protruding part of the plastic envelope 5 acts as a lead-in enabling a soft entrance into the bore without a shock, and also contributes to a rapid separation of the envelope 5 from the bullet 1 as the latter leaves the bore thereby considerably improving the ballistics.

The trapezoidal groove shaped as an equilateral trapezium and provided in the region of the bullet heel portion performs three functions: it separates the heavier nose portion from the heel portion (the best results are achieved if the nose portion is 1.5-3 times heavier than the heel portion); it forms a lock to prevent the envelope from the axial displacement as the bullet shell moves along the bore and thus contributes to creating the contact area between the bullet side surface and the envelope inner surface, which is necessary and sufficient to enable axial rotation of the bullet after it has passed through the rifled choke rifles. Defining the heavier nose portion by means of the trapezoidal groove enables the bullet to pass thought the bushes not deflecting from its trajectory.

With a diameter of 16.4 mm and a length of 27 mm, the bullet made of steel has a weight of 37 g, which is quite sufficient for stopping a wild boar of any size. When loading cartridges with the proposed bullet shells, a polyethylene obturator is placed over the gunpowder, then, a grease felt wad and finally the proposed bullet shell itself. When assembled, the cartridge is rolled by means of conventional curling.

The envelope 5 consists of two identical longitudinal halves. To ensure the identity of the halves, the envelope 5 is advantageously cast as a unit and only thereafter it is cut axially into two identical halves. While separate identical halves may be also produced, their adequacy may hardly be ensured technologically.

After the bullet 1 leaves the bore the two halves of the envelope 5 come off the bullet. Then, the bullet continues it movement independently. As the polyethylene envelope passes through the rifled choke rifles, it is deformed in the rifles and gains rotary motion together with the bullet about the axis.

A soft bullet (lead, copper, etc.) which passes through the rifles of, for example, a carbine entrains particles of the bore rifling metal. As this takes place, the grouping of hits deteriorates with a number of shots due to the gun tube wear. With the use of the proposed bullet shell provided with the plastic envelope 5 no wear occurs, and the bullets spread does not increase with the number of shots.

The proposed two-component bullet shell with a solid bullet, flat nose portion, stepped central passage and soft plastic envelope for rifled choke barrels makes high-accuracy shooting feasible in the clear field and through the bushes, with the grouping of 60 mm within a range of up to 100 m and provides a maximum stopping effect when hunting wild boars with the hunting guns of gauge 12. The shell is also suitable for hunting other big animals such as bears and elks.

In view of the foregoing, the following components are necessary and sufficient for achieving the above-mentioned object: a flat nose portion of the solid bullet; a heavier nose portion as compared to a lighter heel portion tailpiece; a plastic open-bottom envelope completely matching the bullet contours and consisting of two identical halves; a lock preventing the plastic envelope from displacing relative to the bullet as the bullet shell moves along the bore; a stepped axial passage providing a maximum body penetration depth; a sufficient contact area between the solid bullet side surface and the plastic envelope inner surface providing axial rotation of the bullet after it has passed through the "rifled choke"; providing the envelope to protrude beyond the end surface of the bullet nose portion by 1-1.5 mm to ensure that the bullet shell enter the bore softly and with no shock.

The dimensions and the form of the proposed bullet shell as applied to gauge 12 are shown below in Table 1 (dimensions are given in mm):

TABLE 1

Dimensions of the bullet shell for main gauge 12

| D | d | $d_2$ | L | $l_2$ | $l_1/l_2$ | b | $b_1$ | α | $b_2$ |
|---|---|---|---|---|---|---|---|---|---|
| 18.9 | 16.4 | 11.3 | 22.7 | 6 | 1.5 ÷ 3 | 2 | 1 | 120° | 1 |

The taper boring serves the following functions: it increases the body penetration depth; reduces hematomas; and prevents a flat nose portion bullet from losing too fast its speed in the body of an animal. The angle of 120 (plus or minus 5) degrees is believed to be the optimum angle when hunting wild boars and may be readily adjusted either way when hunting other animals, the vital factor being that the nose portion be heavier than the heel one.

The form and dimensions of the lock are of no special importance provided that the lock performs two functions: forming a heavier nose portion as compared to the heel one and preventing the envelope from displacing axially as the bullet shell moves along the bore. As shown in FIG. 1, the bullet shell lock is shaped as an equilateral trapezium with an angle of 45 degrees, although it may be shaped differently, for example as an arc, non-equilateral trapezium, etc. In the proposed bullet shell, a solid bullet is inserted in a split-type open-bottom plastic envelope completely matching the bullet contour and consisting of the identical halves.

Imparting axial rotation to the solid bullet within the plastic envelope as the bullet shell passes through the rifled choke provides grouping of 60 mm within a range of up to 100 m. The proposed bullet shell may be also used for firing the smooth bores, in which case the grouping of shots will be 70 mm per 50 m. When using the proposed bullet shell for rifled chokes, a radically new approach to creating bullet shells for various hunting objects is formed. The weapon gauge (for example, main 12) remains the same for various hunting objects, while the dimensions and the weight of the bullet are selected according to a particular hunting object leaving unchanged the envelope outer diameter and the set of the above components. According to the classic design of the rifled weapon, a hunting object should be identified first and then the weapon gauge.

The proposed bullet shells with a solid bullet may leave the bore at a speed exceeding 500 m/s if only the bore strength suffices. The solid bullet, unlike the lead one for rifled chokes, is not deformed in the bore at any speeds and does not come off the rifles, has a good longitudinal stability both in the clear field and when shooting through the bushes with a range of up to 100 m. No wear of the "rifled choke" rifles occurs at all when the proposed bullet shell is used. The proposed bullet shell is mainly loaded with its heavier nose portion head-on (up). When using the proposed shell, the labor input for cleaning the "rifled choke" bores tapers off markedly as compared to prior art lead bullets. Also, the spread of bullets does not increase if short intervals such as fractions of a second are kept between the shots.

In comparison between rifled choke rifles using the proposed bullet shell with a solid bullet on the one hand, and rifled carbines with bullets therefor on the other hand, in such criteria—upon shooting within a range of up to 100 m—as accuracy, stopping effect, bore durability on retention of grouping, functionality for various kinds of hunting with a single gun, burden of cleaning after shooting, the rifled choke guns offer obvious advantages over the carbines

The invention claimed is:

1. A bullet shell for hunting guns with smooth bores and rifled chokes, comprising:

a cylindrical bullet defined by end surfaces and a side surface and an envelope enclosing said bullet, said bullet being made with a groove on said side surface, said groove delimiting a nose portion and a heel portion of said bullet, said nose portion of said bullet being 1.5 to 3 times heavier and longer than said heel portion of said bullet, said bullet being made with a peripheral flat collar provided at said end surface of said nose portion of the bullet, a conical recess being formed within said nose portion from the side of said end surface of said nose portion inside said collar, said bullet being made of a solid material, said envelope being made of identical longitudinal halves having a cylindrical outer surface and an inner surface matching in contour with said side surface of said bullet, said envelope protruding beyond a plane of said bullet collar.

2. The bullet shell according to claim 1, wherein said groove is made trapezoidal.

3. The bullet shell according to claim 1, wherein said collar has a width of b and a height of $b_1$=0.5b.

4. The bullet shell according to claim 1, wherein an apex angle α of said taper boring is of 120±5°.

5. The bullet shell according to claim 3, wherein said envelope protrudes beyond a plane of said bullet collar by a value of $b_2$=$b_1$.

6. A bullet shell for hunting guns with smooth bores and rifled chokes, comprising:

a cylindrical bullet defined by end surfaces and a side surface and made of a material essentially non-deformable in a barrel bore and a thin-walled plastic envelope enclosing said bullet, said bullet being made with a trapezoidal groove on a side surface thereof, said groove delimiting a nose portion and a heel portion of said bullet, said nose portion of said bullet being 1.5 to 3 times heavier and longer than said heel portion of said bullet, said bullet being made with a peripheral flat collar of b in width and of $b_1$=0.5b in height provided at an end surface of said nose portion of said bullet, a conical recess being formed within said nose portion from the side of said end surface of said nose portion inside said collar, an apex angle α of said conical recess being of 120±5°, said envelope being made of identical longitudinal halves having a cylindrical outer surface and an inner surface matching in contour with said side surface of said bullet, said envelope protruding beyond the plane of said bullet collar by a value of $b_2$=$b_1$.

* * * * *